United States Patent [19]

Repé et al.

[11] Patent Number: 4,879,941

[45] Date of Patent: Nov. 14, 1989

[54] EJECTABLE CLOSING DEVICE, ESPECIALLY FOR ROCKETS WITH MUNITIONS

[75] Inventors: Thouron Repé, La Ferte St Aubin; Denis J. Francois, Checy, both of France

[73] Assignee: Thomson-Brandt Armements, Boulogns Billancourt, France

[21] Appl. No.: 210,973

[22] Filed: Jun. 24, 1988

[30] Foreign Application Priority Data

Jul. 3, 1987 [FR] France ..... 87 09453

[51] Int. Cl.[4] ..... F42B 25/16; F16C 35/00

[52] U.S. Cl. ..... 89/1.14; 102/393; 102/489; 102/378

[58] Field of Search ..... 102/393, 489, 400, 351, 102/357, 377, 378; 89/1.14

[56] References Cited

U.S. PATENT DOCUMENTS

| | | | |
|---|---|---|---|
| 2,489,984 | 11/1949 | Shoemaker | 89/1.14 |
| 2,809,584 | 10/1957 | Smith | 102/378 |
| 3,070,018 | 12/1962 | Fahl | 102/378 |
| 3,362,290 | 1/1968 | Carr et al. | 102/378 |
| 3,458,217 | 7/1969 | Pride et al. | 102/378 |
| 3,465,482 | 9/1969 | Chandler | 102/378 |
| 3,902,400 | 9/1975 | Kincheloe et al. | 102/393 |
| 4,455,943 | 6/1984 | Pinson | 102/489 |
| 4,524,694 | 6/1985 | Boeder | 102/393 |
| 4,558,645 | 12/1985 | Boeder et al. | 102/393 |
| 4,688,486 | 8/1987 | Hall et al. | 102/489 |

FOREIGN PATENT DOCUMENTS

| | | |
|---|---|---|
| 0114602 | 2/1986 | European Pat. Off. . |
| 2920347 | 11/1980 | Fed. Rep. of Germany . |
| 2557286 | 6/1985 | France . |
| 2169067 | 7/1986 | United Kingdom . |

*Primary Examiner*—David H. Brown

*Attorney, Agent, or Firm*—Roland Plottel

[57] ABSTRACT

Disclosed is a device designed to close a munitions compartment of a rocket and to be ejected just before the munitions so as to open the compartment. This device has a lid locked with a key and an inflatable balloon used to release the lid from the key and to dismantle the device without breaking it, by completely expelling the lid.

9 Claims, 5 Drawing Sheets

EJECTABLE CLOSING DEVICE, ESPECIALLY FOR ROCKETS WITH MUNITIONS

BACKGROUND OF THE INVENTION

The present invention concerns a device for closing a structure such as, for example, a munitions compartment of a rocket. This device can be ejected upon command, so that the structure is opened at the desired moment.

Current military strategy used to neutralize vital enemy installations such as, for example, landing areas, entails two stages:

in the first stage, a rocket with munitions is either sent above the zone to be neutralized by means of a launching tube or is jettisoned from an aircraft;

in the second stage, the munitions are ejected on command.

Methods for releasing munitions are widely known and shall not be described below. The invention relates to the closing of the compartments by means of devices that can be released upon command.

Such devices exist. A known device consists of a hatch, embrittled in certain places and fixed to the compartment at other places. An outward thrust from the compartment is given at the embrittled portions which break and then go beyond the fuselage of the rocket. The aerodynamic drag coefficient (hereinafter marked Cx) of this rocket is then modified and this difference in Cx causes the hatch to be partially torn away. Since the hatch is only partially torn away, the opening of the compartment is not adequately controlled and there is the risk that pieces of the hatch may hamper the passage of the munitions.

SUMMARY OF THE INVENTION

An object of the present invention is to remove this drawback. The invention concerns an ejectable closing device for a structure, such as a munitions compartment for example, which is not broken but dismantled when it is ejected. The structure is closed by a lid held in position by locking means. A thrust of the locking means, outward from the structure, releases the lid of these locking means and then completely expels the lid preferably by triggering spring devices.

the lid of the device according to the invention being totally expelled, the opening of the structure is perfectly controlled and reproducible.

More precisely, an object of the present invention is an ejectable closing device for a structure, said device comprising:

a lid;

means for outward thrusting from said structure, said device further comprising:

means to lock said lid;

means to transmit said thrust to said locking means, said thrust being capable of releasing said lid from said locking means and, then, of causing the complete expulsion of said lid.

BRIEF DESCRIPTION OF THE DRAWINGS

Specific features and various embodiments of the invention will emerge from the following description, illustrated by the appended figures, of which.

In these various figures, the same references refer to the same elements.

DESCRIPTION OF THE PREFERRED EMBODIMENTS

Figure 1:
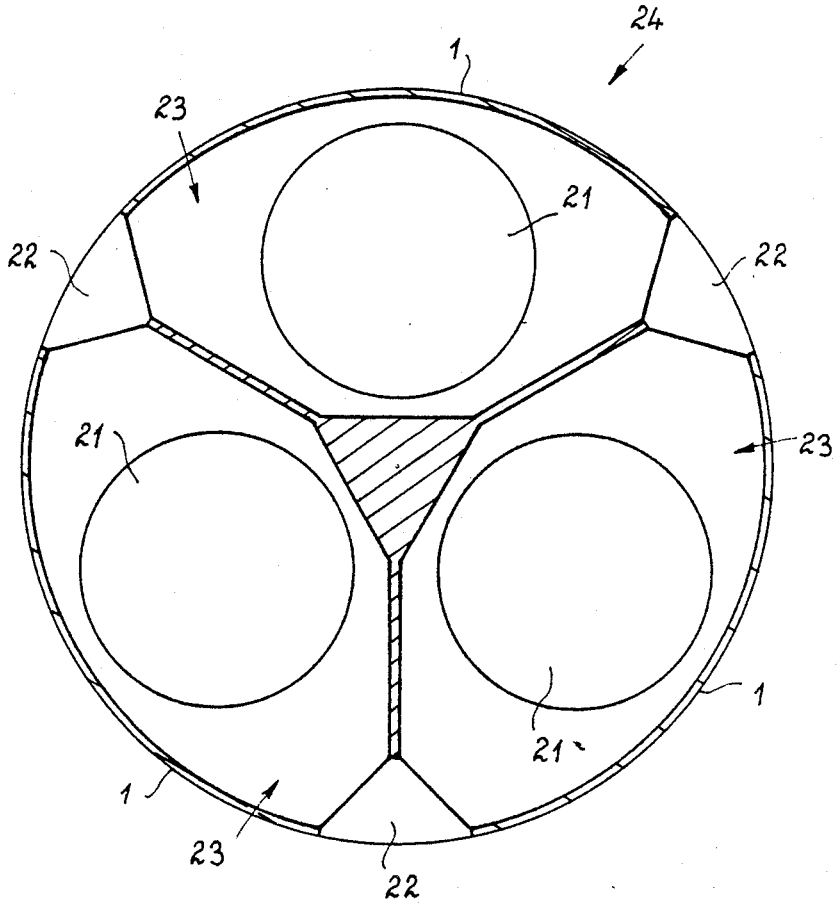
FIG. 1 shows a cross-section of a rocket comprising three devices according to the invention.

The following description will be made, as an example with reference to an application of the device, according to the invention, to the closing of a rocket compartment containing munitions.

the rocket comprises a cylindrical part 24 in which munitions compartments are located. FIG. 1 shows an example of a configuration of a cylindrical part 24 of this type. The rocket has three compartments 23, for example identical compartments, each containing one piece of munition 21. The compartments 23 are closed by lids 1 located on the edge of the cylindrical part 24, the longitudinal edges of these lids 1 being fixed, according to the invention, by means 22 (the transversal edges of these lids are fitted into the part 24). The cylindrical part 24 has as many means 22 as it has lids 1. Each means 22 holds two different lids 1 and, reciprocally, two opposite longitudinal edges of a given lid 1 are held by two different means 22. hereinafter, the fixing of only one longitudinal edge of a lid 1 by a single unit 22 shall be described.

Figure 2:
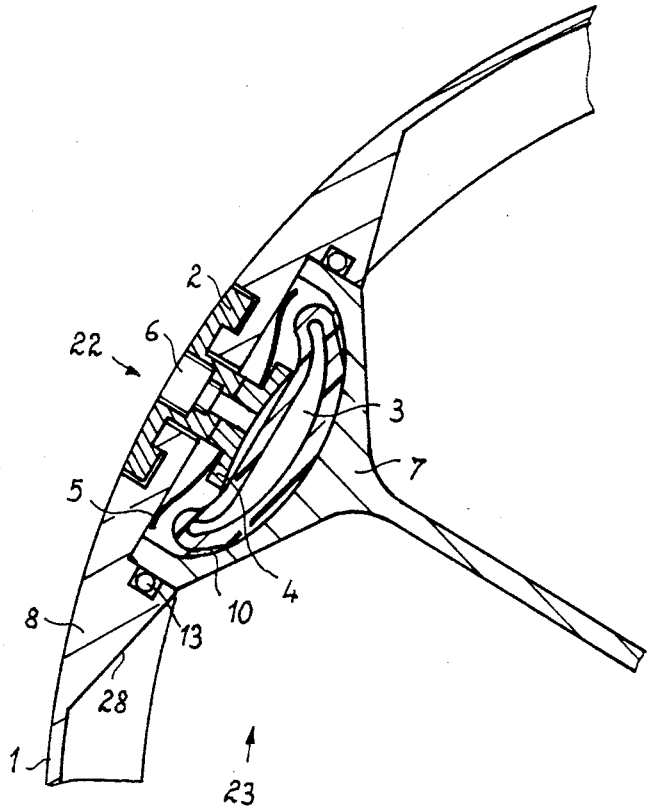
FIG. 2 is a partial section of a first embodiment of the device according to the invention before it is ejected.

FIG. 2 shows a section of a first embodiment of the device according to the invention, comprising a lid 1, only one part of which is sketched in the figure, and means 22 which is entirely shown. This figure illustrates the configuration of the device before it is ejected. The edge 8 of the lid 1 is held by the means 22 comprising:

a part 2, called a "key", fitted inside the edge 8 and clamping the external part of this edge 8, thus locking the lid 1;

means to thrust the key 2 and the edge 8 outwards from the structure, said thrusting means comprising an inflatable membrane 3. A part 10 of the membrane 3 is fixed, for example, by bonder to the edge 7 of the compartment 23. This edge 7 has the shape of a cup to the bottom of which the part 10 is bonded;

means for transmitting this thrust, comprising a rigid small bar 4 and a spring leaf 5; the small bar 4 is located between the key 2 and the membrane 3; the spring 5 is compressed between the small bar 4 and the edge 8 of the lid 1 throughout the period between the assembly of the device and the ejection of this same device; the spring is said to be "prestressed" between the small bar 4 and the internal part of the edge 8;

a screw 6 for fixing the key 2 to the small bar 4; this fixing means holds the device in position before it is ejected.

The edge 8 of the lid 1 has a bulge 28 which presses against the edge 7 of the compartment 23. A seal 13 located between the edges 8 and 7 gives imperviousness to the closing of the compartment 3 as it is not desirable for the munitions to get wet or damp.

Figure 3:
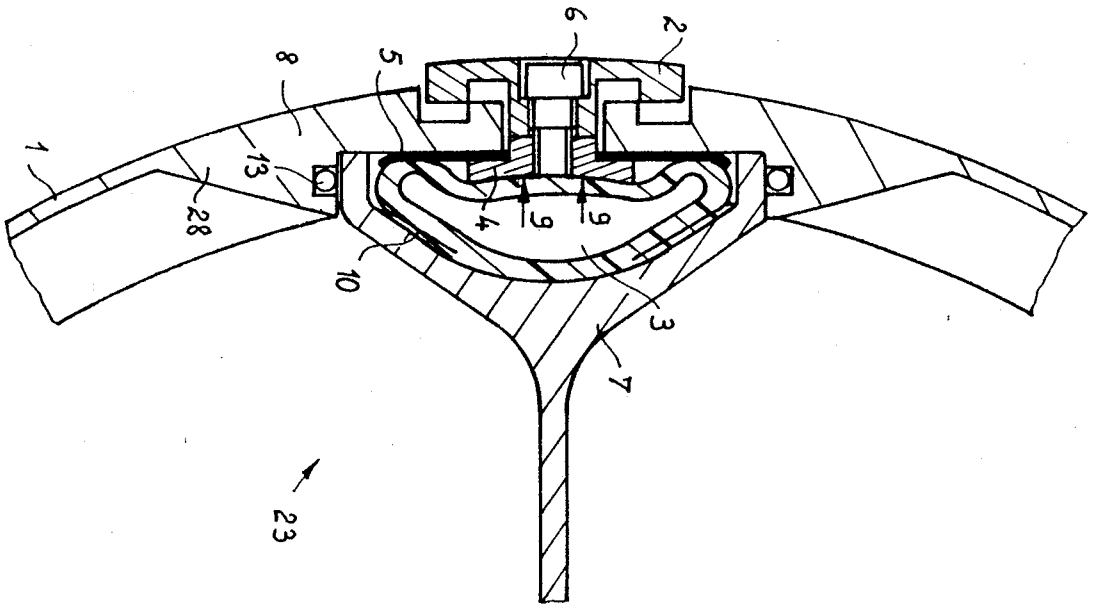
FIG. 3 is a partial section of the device of FIG. 2 at the start of its ejection.
Figure 4:
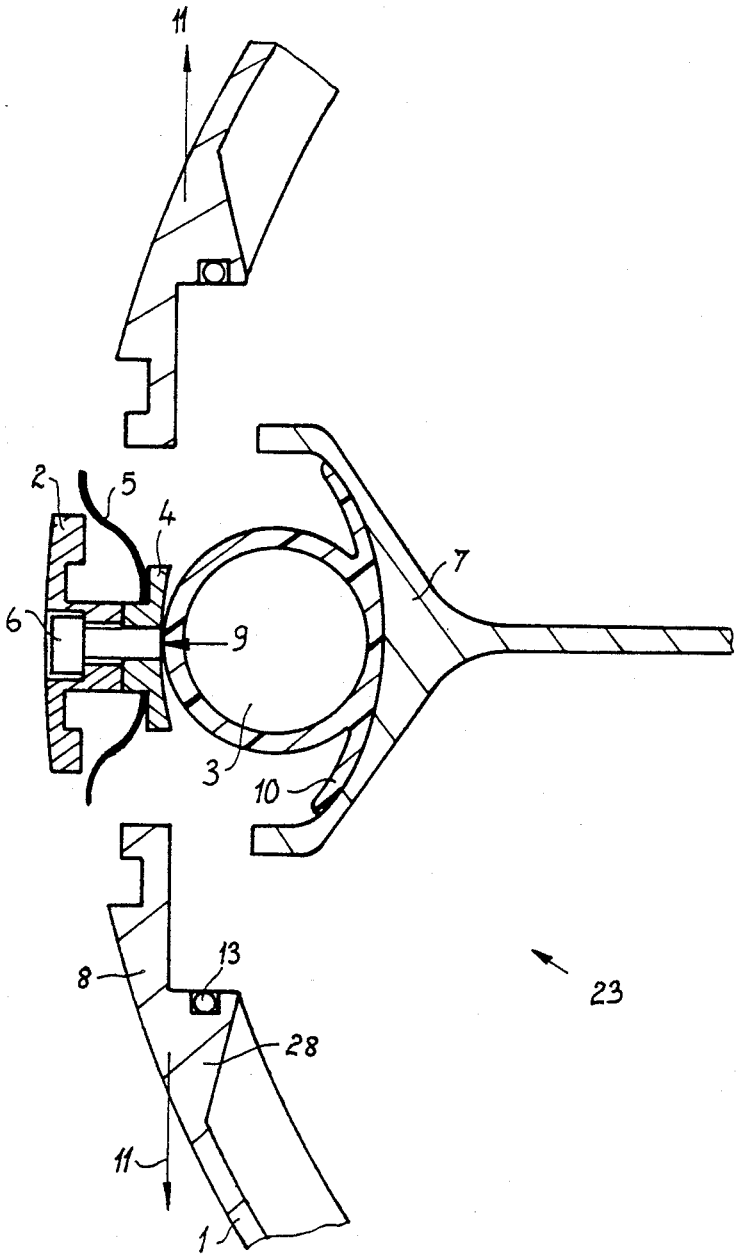
FIG. 4 is a partial section of the device of FIG. 2 at the end of its ejection.

FIGS. 3 and 4 illustrate the ejection of the device of FIG. 2.

This type of ejection is triggered by the inflation of the membrane 3 which is connected, for example, to a pyrotechnical gas generator, not shown in FIGS. 2 to 4. Techniques for inflating membranes designed to give thrust of any kind are known *per se* and shall, therefore, not be described herein. In becoming inflated, the membrane 3 exerts a thrust which is radial (with respect to the edge 7 of the compartment 23) and centrifugal 9 (with respect to the cylindrical part 24 of the rocket).

the thrust 9 is exerted on the small bar 4, thus compressing the spring 5 as shown in FIG. 3. The shape of the small bar 4 enables the key 2 to come apart from the edge 8. In FIG. 3 the key 2 has almost become unfixed.

As soon as the key 2 gets unfixed, the spring 5 is released and thus expels the edge 8 of the lid 1 as shown by the arrows 11 in FIG. 4. According to the embodiment described, the seal 13 remains fixed to the edge 8 when this edge is expelled. The membrane 3 continues to get inflated and thrusts the elements 4, 5, 2 and 6 in the direction of the arrow 9. The situation obtained is shown in FIG. 4: the device is dismantled. The rocket is preferably subjected to a rotation on its axis in a way known to those skilled in the art, the resultant centrifugal force making it possible, in particular, to boost the ejection of the above-mentioned elements. The various elements then go beyond the rocket fuselage, thus modifying its Cx. This difference in Cx causes, firstly, the lid 1 and, secondly, the elements 2, 6, 4 and 5 to be torn away. Only the membrane 3 remains at least partially fixed to the edge 7 of the compartment 3, but it in no way hampers the ejection of the munitions.

Figure 5:
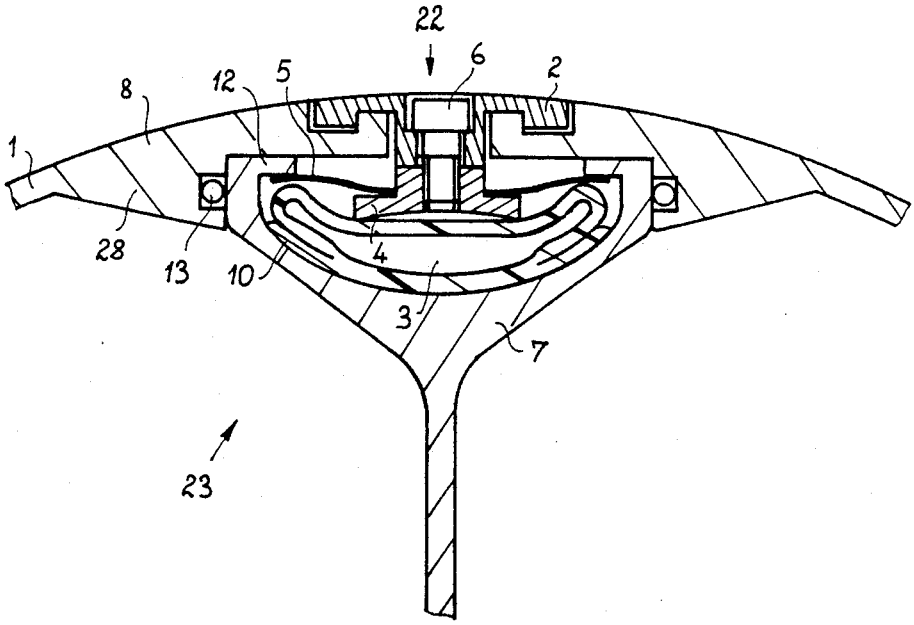
FIG. 5 is a partial section of a second embodiment of the device according to the invention.

FIG. 5 shows a section of a second embodiment of the device according to the invention before it is ejected. The second embodiment differs from the first one through the fact that the edge 7 of the compartment 13 has a shoulder 12. The spring 5 is pre-stressed between the small bar 4 (as in the case of FIG. 2) and this shoulder 12 (instead of the edge 8 of the lid 1), thus providing greater releasing force in the spring 5 than is the case in the first embodiment.

The device of FIG. 5 works like that of FIG. 2 except as regards the spring 5. This spring is first compressed by the radial and centrifugal thrust caused by the inflation of the membrane 3 (as in FIG. 3); once the key gets unfixed, the spring 5 is released from the shoulder 12 (unlike in FIG. 3) and expands, pushing on the edge 8 of the lid 1 (as in FIG. 4).

Figure 6:
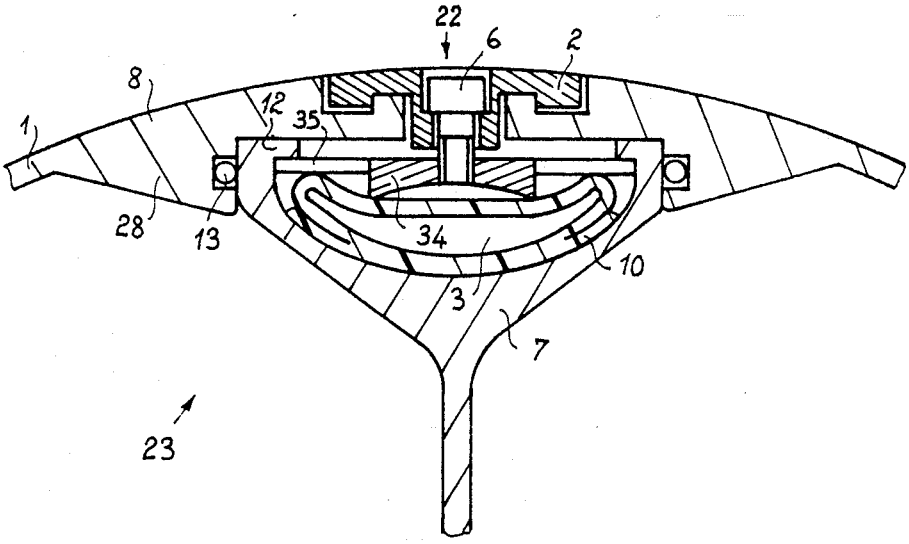
FIG. 6 is a partial section of a third embodiment of the device according to the invention.

FIG. 6 shows a section of a third embodiment of the device according to the invention before it is ejected. The third embodiment differs from the second one in that it has a monobloc small bar consisting of a rigid part 34 and an elastic part 35 instead of the rigid small bar 4 and the spring leaf 5. The parts 34 and 35 respectively fulfil the same functions as the elements 4 and 5 of FIG. 6. Nevertheless, the elastic part 35, unlike the spring 5 is not at all compressed before the ejection of the device. Consequently, its elasticity is in no risk of being reduced through excessively prolonged prestress, given that military equipment is sometimes stored for long periods. The device of FIG. 6 is therefore more reliable than that of FIG. 5 or that of FIGS. 2, 3 and 4.

What is claimed is:

1. An ejectable closing device for a structure said device comprising:

a lid;

means for locking said lid;

means for producing a thrust outwards from said structure;

means for transmitting said thrust to said locking means, causing said locking means to unlock said lid;

spring means coupled to said transmitting means and extending under the inner edge of said lid for expelling said lid apart from said transmitting means once said lid has been unlocked.

2. A device according to claim 1, wherein said transmitting means and said spring means comprise a monoblock small bar consisting of a rigid part and an elastic part, said elastic part constituting said spring means.

3. A device according to claim 2, wherein said locking means comprise a key fitted into the edge of said lid and screw for fixing said key to said rigid part of said monoblock small bar.

4. A device according to claim 1, wherein said thrusting means comprise an inflatable membrane, the inflation of said membrane causing said thrust.

5. A device according to claim 4, wherein said thrusting means comprise a part fixed to the edge of said structure.

6. A device according to claim 4, wherein said transmitting means comprise a rigid small bar placed between said inflatable membrane and said locking means.

7. A device according to claim 6, wherein said spring means consist of a spring leaf initially prestressed between said small bar and the edge of said lid.

8. A device according to claim 6, wherein the edge of said structure comprises a shoulder and wherein said spring means consist of a spring leaf initially prestressed between said small bar and said shoulder.

9. A device according to claim 6, wherein said locking means comprise a key fitted into the edge of said lid and a screw for fixing said key to said small bar.

* * * * *